United States Patent [19]

Fröhlich et al.

[11] 4,084,297

[45] Apr. 18, 1978

[54] SLIDE FASTENER

[75] Inventors: Alfons Fröhlich; Franz Hochlehnert, both of Essen, Germany

[73] Assignee: OPTI Patent- Forschungs- und Fabrikations-AG, Glarus, Switzerland

[21] Appl. No.: 722,047

[22] Filed: Sep. 10, 1976

[30] Foreign Application Priority Data

Sep. 10, 1975 Germany ..... 2540272
May 18, 1976 Germany ..... 2622070

[51] Int. Cl.[2] ..... A44B 19/12
[52] U.S. Cl. ..... 24/205.13 C
[58] Field of Search ..... 139/384 B; 24/205.1 C, 24/205.13 C, 205.16 C

[56] References Cited

U.S. PATENT DOCUMENTS

| | | | |
|---|---|---|---|
| 3,247,871 | 4/1966 | Lacam et al. | 24/205.13 C |
| 3,699,618 | 10/1972 | Jakob | 24/205.13 C |
| 3,906,595 | 9/1975 | Moertel | 24/205.13 C |
| 3,961,652 | 6/1976 | Hasuda et al. | 24/205.16 C |

FOREIGN PATENT DOCUMENTS

| | | | |
|---|---|---|---|
| 1,284,216 | 1/1962 | France | 24/205.13 C |

*Primary Examiner*—Henry S. Jaudon
*Attorney, Agent, or Firm*—Karl F. Ross

[57] ABSTRACT

A slide fastener comprises a pair of coiled coupling rows of synthetic-resin monofilament with each coupling element having a coupling loop or eye formed with a coupling head, a pair of monofilament segments extending away from the head, and connecting shanks joining adjacent coupling elements together. The shanks are received in pockets formed by longitudinal threads which pass alternately over and under the shanks so that the longitudinal threads and the shanks form a tape-like unit or support structure. Preferably the longitudinal threads constitute a warp with the shanks acting as a weft for the tape-like unit. The coupling elements have a generally elliptical or flattened cross section whereby the coupling eye has its axis generally parallel to the major axis of the cross section of the monofilament.

8 Claims, 27 Drawing Figures

VIII
VIII 16
17
10
9
7
4
6
5
8
11
6a
3
1
XVI
XVII
XVIII
XV 108
110
111
115

111
XXII 108
110
116
116
111

SLIDE FASTENER

CROSS-REFERENCE TO RELATED APPLICATIONS

This application is related to the commonly assigned concurrently filed copending applications Ser. Nos. 722,265 722,339 and 722,048.

FIELD OF THE INVENTION

The present invention relates to a slide fastener and, more particularly, to improved and highly stable slide-fastener-stringers.

BACKGROUND OF THE INVENTION

A conventional slide fastener generally comprises a pair of support tapes having confronting edges provided with rows of coupling elements which may be interconnected and formed by a continuous synthetic-resin monofilament. These coupling elements can be affixed to the tape by stitching or various other means, generally involving the interposition of a textile thread between the coupling elements or the coupling heads formed thereby. The coupling heads may be deformed to provide protuberances which engage behind the protuberances of a pair of coupling heads of the opposite row.

An important characteristic of such slide fasteners, whether the row of coupling elements is a coil or a meander, is the ability of the slide fastener to resist transverse stresses which tend to spread apart the coupling elements and cause release of the coupling head received between them.

Generally the slide fastener must be capable of resisting longitudinal stresses which arise upon stretching of the article in which the slide fastener is incorporated, transverse stressing in the plane of the slide fastener which tends to open the gap spanned by the slide fastener, transverse stress orthogonal to the plane of the slide fastener, and torsional stresses which arise upon twisting of the slide fastner. While various head configurations have been proposed to resist the transverse and longitudinal stresses mentioned above, the importance of resisting torsional stress has come to the fore only recently.

Torsional strength is the strength with which the slide fastener resists separation upon the application of torque between coupling elements about the longitudinal axis of the slide fastener. It will be appreciated that all of the other stresses can give rise to torsional stress in a sense and that torsional stress can also result in longitudinal and transverse stress. In any event, the principal characteristic of torsional stress is the tendency of such stress to deflect each couping head out of engagement with the other coupling element in a plane transverse to the longitudinal axis of the coils.

The stresses arise when a slide fastener is used, for example, in garments or the like and can result from acceleration in centrifugal machines such as extractors, dryers or washers as well as dry-cleaning machines and the like. The torsional resistance or torsional strength of the slide fastener can be increased by increasing the length of the shanks of the coupling elements as is the case when strip fasteners are provided. The copending applications mentioned above are directed at least in part to such fasteners.

Strip fasteners, for the purposes of the present invention, are slide fasteners in which the shanks of the coupling elements reach entirely across the width of the tape-like units in which they are formed at least in part as a weft, the shanks lying in pockets formed by longitudinal threads which cross over from side to side between these shanks. Since the shanks extend across the width of the strip, their bights which interconnect the shanks of adjacent coupling elements can form ridges, as described in the aforementioned applications, to guide a slider.

Of course, the strip fasteners can be stitched directly to a garment, in which case the stitches are applied along the shanks and between them. Alternatively, the strip fasteners can be integrated with respective support tapes with corresponding longitudinal threads which, however, can have a textile weft filament looping around the turns of the coupling element.

The latter systems can distinguish from the conventional arrangements in which a textile thread is interposed between successive coupling elements and which are susceptible to dimensional changes because of shrinkage or the like of the interposed textile threads.

OBJECT OF THE INVENTION

It is the principal object of the invention to provide a slide fastener, preferably of the type described in the aforementioned copending applications, with improved torsion strength whether or not the coupling elements have long connecting shanks.

SUMMARY OF THE INVENTION

This object and others which will become apparent hereinafter are attained, in accordance with the present invention, in a slide fastener having interdigitable rows of coupling elements, each row being formed by a synthetic-resin monofilament, with coupling elements having a generally ellipsoidal or flattened round cross-section. According to the invention the cross-section has a long functional axis and a short functional axis, which axes are orthogonal to one another.

According to an essential feature of the invention, in the region of the coupling heads and the coupling eyes, the long axis lies parallel to the slide-fastener plane and hence to the confronting edges along which the rows can be interconnected. In the region of the bights which the shanks remote from the coupling heads, the long axis lies perpendicular to the plane of the slide fastener or, put another way, the short axis lies parallel to the slide fastener plane.

In regions between the coupling eyes and the bights, the connecting shanks have transition twists which permit the long axis to rotate through 90° between the eye and the bight, these transition twists being concentrated in the region of the eye, concentrated in the region of the bight, or extending uniformly over the length of the shanks.

In a preferred embodiment of the invention, the shanks of each coupling element are pressed into greater surface contact than is afforded by the applied ellipsoidal configuration for more effective abutting relationship and hence greater torque-resisting stiffness.

The coupling heads can be bulged outwardly at their ends lying parallel to the confronting edges of the slide fastener by buckling the ellipsoidal filament in the regions of the heads, the ellipsoidal configuration, the buckled heads and, if desired, buckled bights being set by a thermofixing operation. The additional bedding of the shanks against one another can be made permanent by thermofixing as well or by hot-pressing the shanks together to accomplish simultaneously the additional deformation and the thermofixing process.

Best results are obtained with a ratio of the length of the short axis of the cross-section to the length of the long axis between 1:1.5 and 1:2.

Most surprisingly, by comparison with conventional coupling elements and even those of the above-identified copending applications, using circular-cross-section monofilament, the torsion strength of the slide fastener is greatly improved. Apparently this torsion strength is improved because of the fact that the polar moment of inertia continuously varies along the shanks, the bights are more resistant to bending stresses and the coupling heads are made more rigid in planes perpendicular to the slide fastener plane and the axis of the eye. While the coupling element retains flexibility sufficient to enable it to operate, e.g., with a slider of the type shown in the concurrently filed application Ser. No. 722,048, the system is highly resistent to separation resulting from torsional stress.

The thermofixing can be carried out over the entire coupling elements and the coupling heads can be provided with any lateral formation simply by buckling as described. All that is necessary is that the normally circular monofilament be pressed prior to forming the coupling elements to impart the flattened or ellipsoidal cross-section thereto. This flattening can be such as to elongate the cross-section to a dimension greater than the long functional axis so that, upon thermofixing, the cross-section is brought into the ellipsoidal profile mentioned above.

The apparatus for making the coupling elements can include flattening rollers for shaping the profile of the circular monofilament, followed by a forming station constituting part of the loom in which the coupling elements are laid down, the forming station being disposed immediately ahead of a thermofixing station. The loom may be of the type generally described in the copending applications mentioned previously, Ser. Nos. 722,265 and 722,339 or a conventional forming station in which the strand is coiled.

The process of the invention thus involves initially flattening the synthetic-resin monofilament, e.g., between a pair of rollers, and without embossing or otherwise producing spaced-apart deformations therein, laying the strand to buckle it in forming the coupling head, twisting the strand through 90° along a shank, bending the strand to form the bight, twisting the strand again through 90° and repeating the process for each coupling element.

According to a preferred embodiment of the invrention, the monofilament is cold-formed at a temperature below the vitreous transition temperature which is about 70° C for polyethyleneterephthalate and about 30° C for polybutyleneterephthalate and polyamide. Below this glass transition point there is no molecular movement upon deformation in the monofilament so that the cross-sectional change is relatively reversible. The long and short axes are altered by about 10 to 25% during the subsequent thermofixing which may be carried out by means of heat or ultrasonics.

The starting material is preferably synthetic-resin monofilament of circular cross-section (polyamide or polyester) which has been stretched in a stretching ratio of 1:3.5 to 1:5.

An advantage of the invention resides in the fact that the formation of singular embossed locations spaced along the strand or filament are eliminated so that the monofilament is more readily and accurately shaped in the loom or other machine.

BRIEF DESCRIPTION OF THE DRAWING

The above and other objects, features and advantages of the present invention will become more readily apparent from the following description, reference being made to the accompanying drawing in which.

Figures 14, 15, 16, 16A, 17, 18:
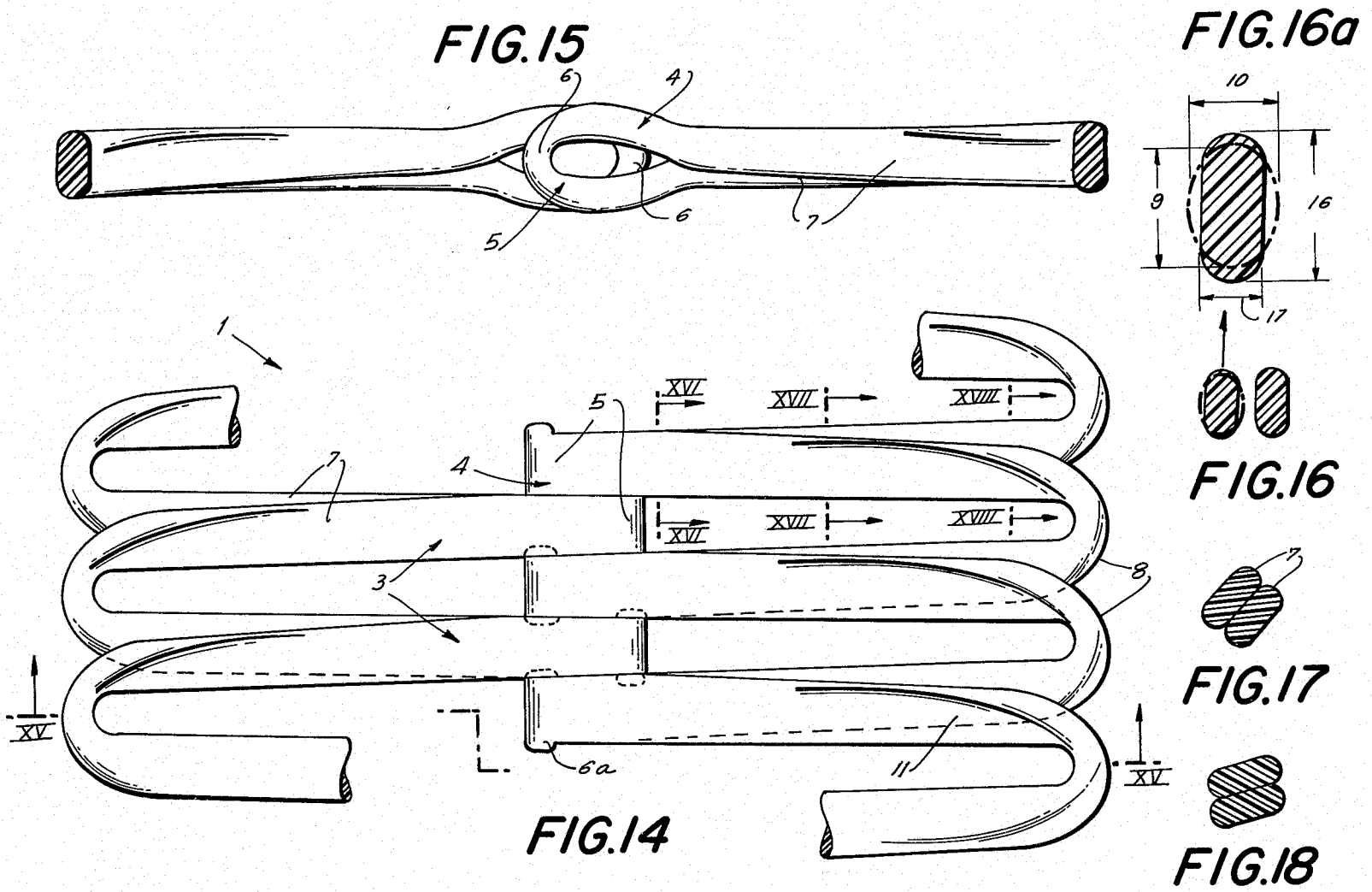
FIG. 14 is a view similar to FIG. 2 but illustrating still another embodiment of the invention as made by the apparatus of FIG. 13.
FIG. 15 is a section along the line XV—XV of FIG. 14.
FIG. 16 is a cross-sectional view taken along the line XVI—XVI of FIG. 14.
Figure 19:
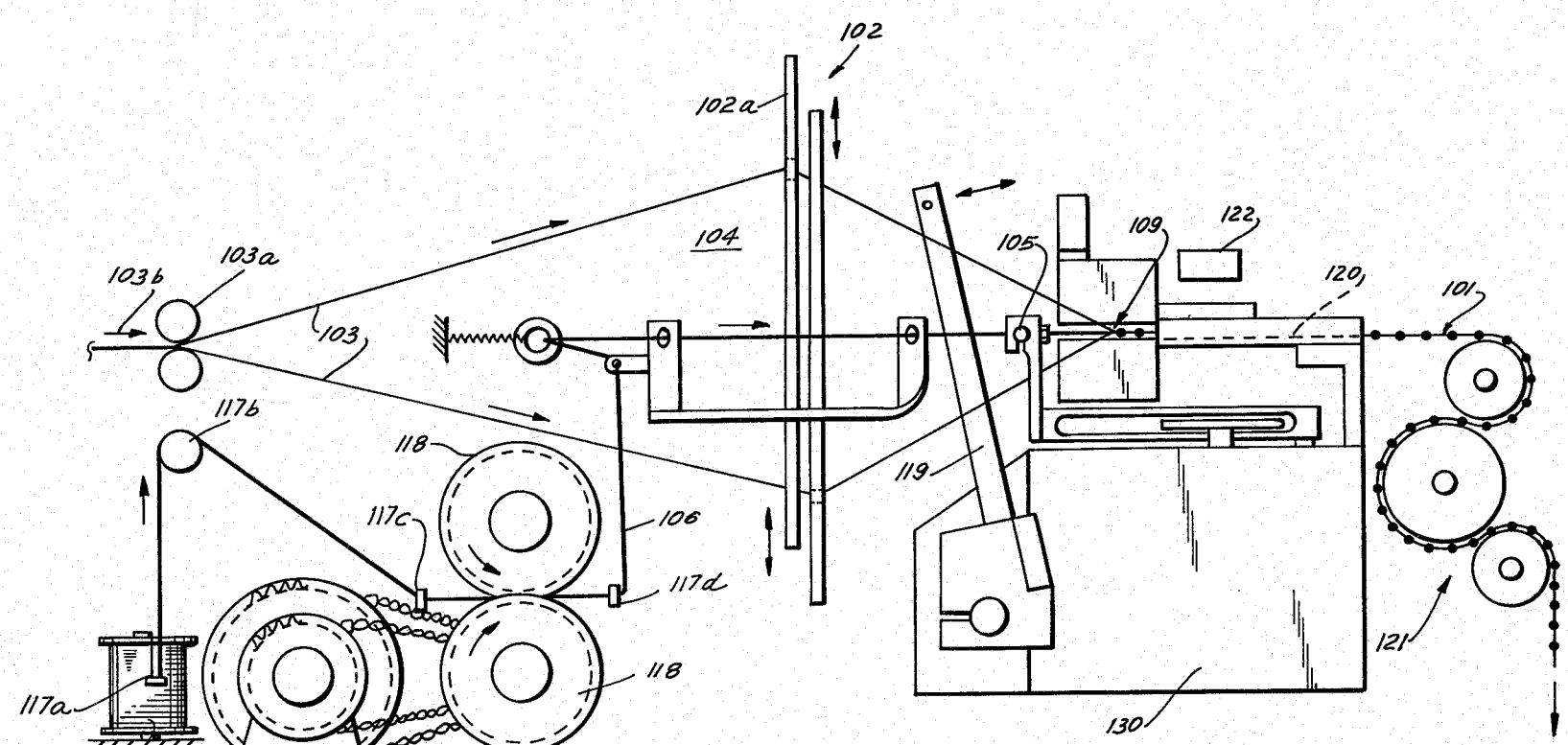
Figure 20:
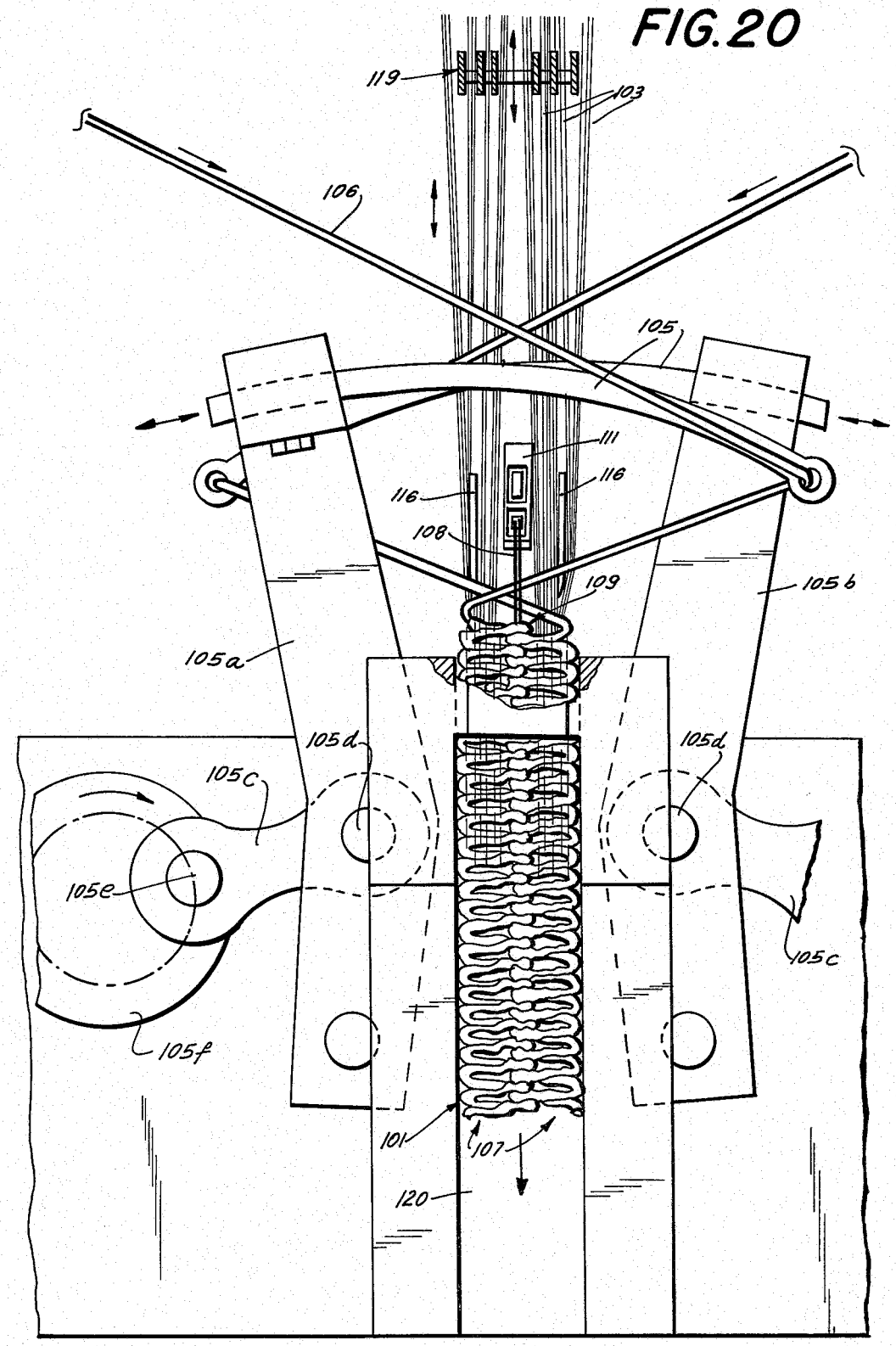
Figure 21:
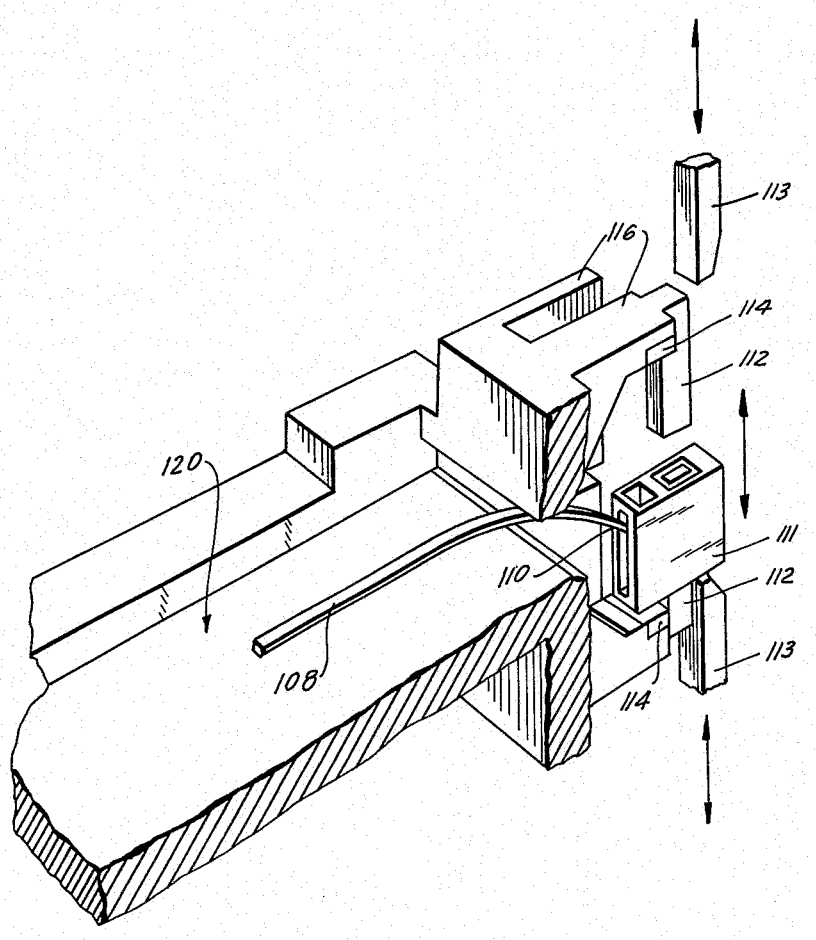
Figures 22, 22A, 22B:
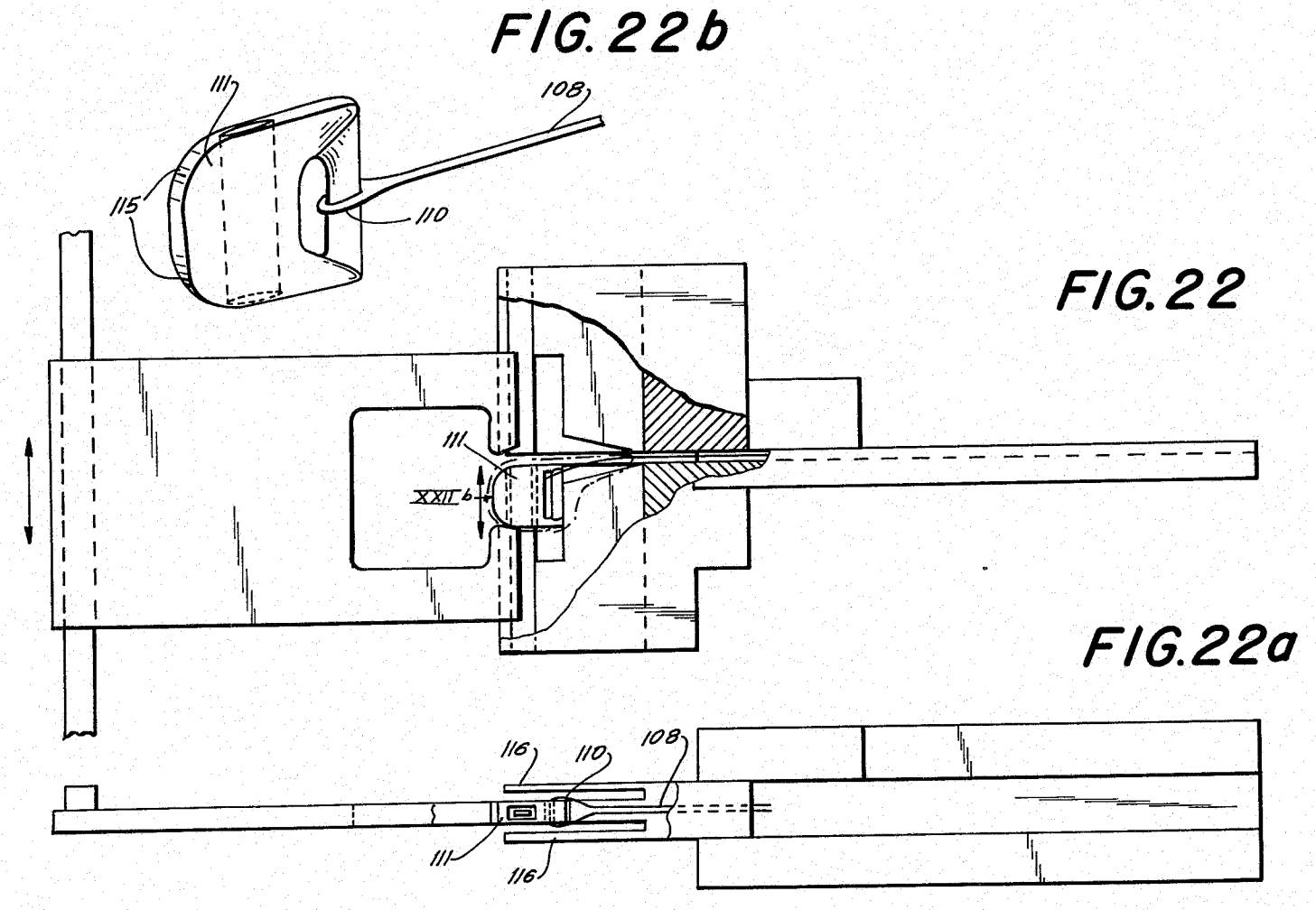
Figure 23:
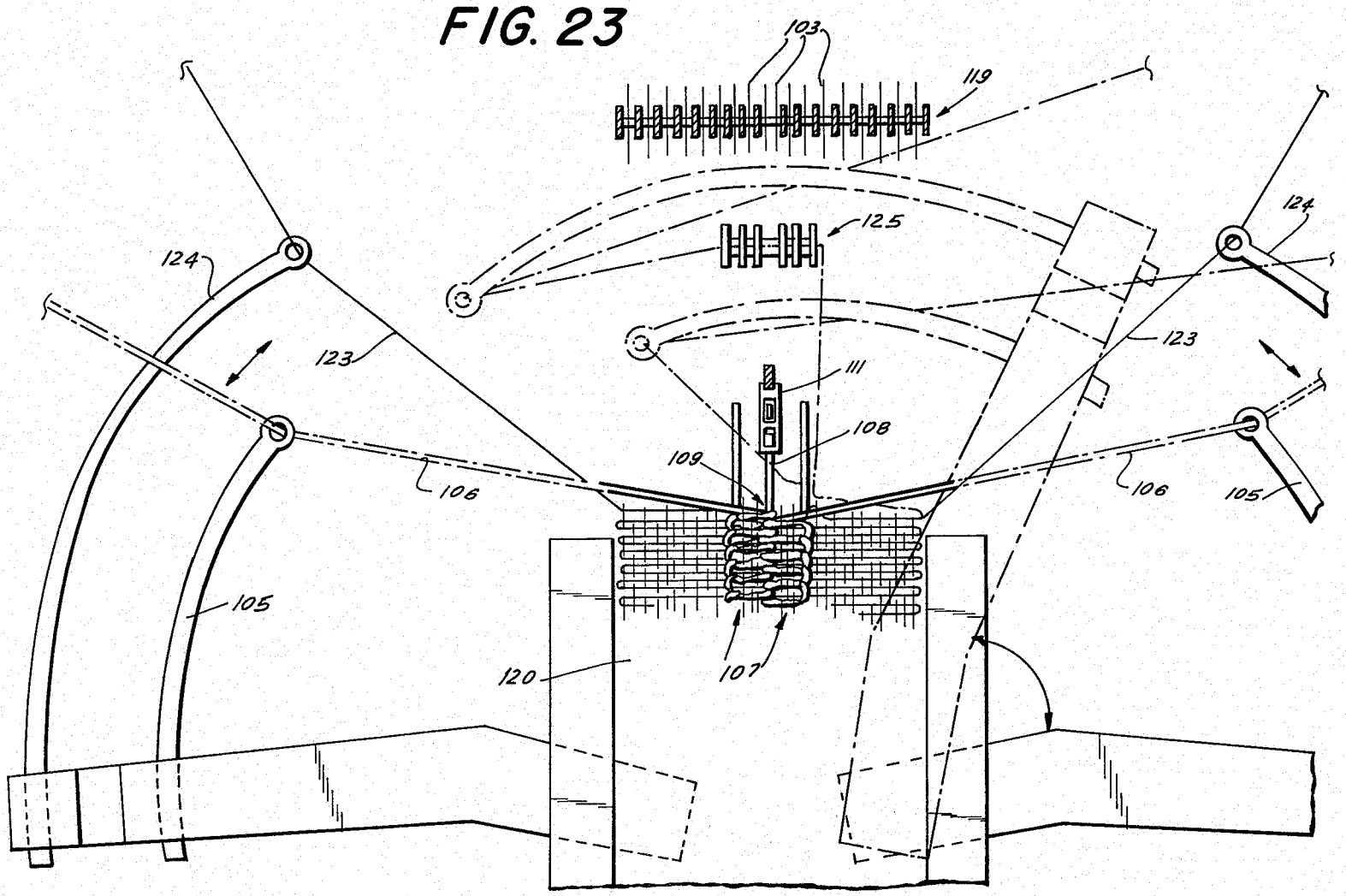
Figure 24:
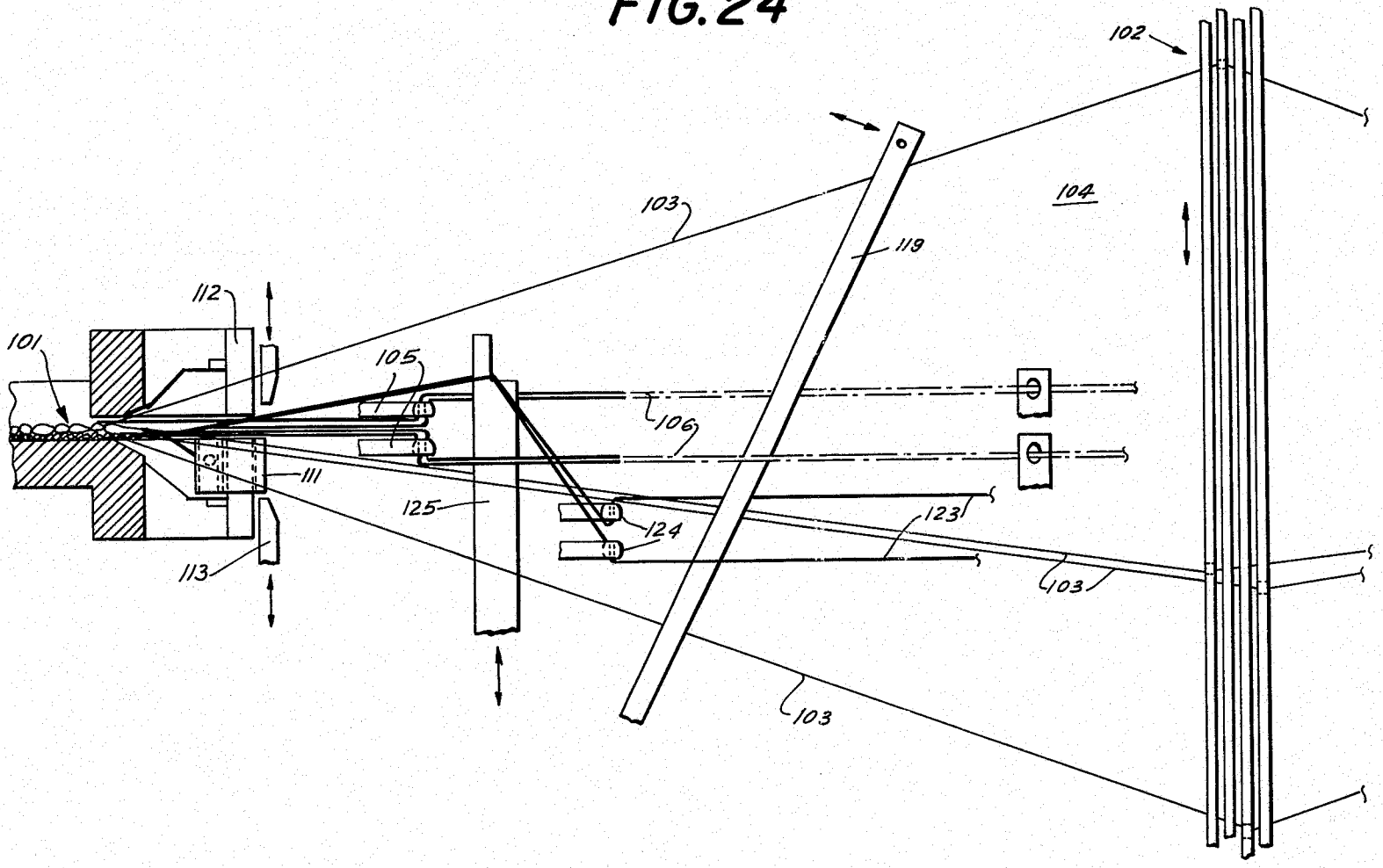

FIG. **16*a* is an enlarged view of one of the shanks of FIG. 16**;

FIG. 17 is a cross-sectional view along the line XVII—XVII of FIG. 14;

FIG. 18 is a cross-sectional view taken along the line XVIII—XVIII of FIG. 14;

FIG. 19 is a side-elevational view of a loom for producing strip slide fastener halves according to the present invention, the apparatus being shown in diagrammatic form;

FIG. 20 is a plan view of a portion of the apparatus of FIG. 19;

FIG. 21 is a perspective view, partly in section, of the mandrel holder of FIGS. 19 and 20;

FIG. 22 is a side-elevational view in another embodiment of a mandrel holder according to the invention;

FIG. **22*a*** is a plan view of the latter;

FIG. 22*b* is a perspective view of a portion XXII*b* of the holder of FIG. 22;

FIG. 23 is a view similar to FIG. 20 but illustrating another embodiment of the loom according to the invention; and FIG. 24 is a side-elevational view of the shed-forming portion of the loom of FIG. 23.

SPECIFIC DESCRIPTION

In the following description, reference will be made to rows of coupling elements formed by coiling synthetic-resin monofilaments which are flattened from their original cylindrical configuration to have a generally ellipsoidal cross section. The term "ellipsoidal" is here used to refer to an elongated structure having rounded small ends and generally flat broad sides, the cross section having a major diameter or dimension and a minor diameter or dimension, in accordance with conventional ellipse terminology. Furthermore, the coupling rows may be fabricated into strip-like slide fasteners in which shanks of the coupling elements extend as the exclusive weft or as part of the weft of a tape-free structure formed by the coupling elements and longitudinal threads. When the weft and the longitudinal threads constitute weft and warp of a weave, respectively, the coupling elements are located in pockets formed by the warp. However, the shanks of the coupling elements can also be received in courses of a warp-knit strip in which the longitudinal threads are formed as loop chains corresponding to the warp of a woven strip.

The rows of coupling elements shown fragmentarily in the Figures of the drawing comprise basically coils 2 of the interdigitated pair of coils 1 of a slide fastener. The coils form coupling elements 3 of synthetic-resin monofilament which have coupling eyes 4 each defining coupling heads 6. The coupling heads 6 are enlarged longitudinally of the slide fastener so as to interfit between the coupling heads of the opposite row, the eyes 4 being formed by synthetic-resin monofilaments segments 5 which extend rearwardly into shanks 7.

Shanks 7 of the individual coupling elements 4 lie next to one another and can abut directly so that each pair of shanks of a given coupling element lie in a common pocket of the warp.

The shanks 7 of adjoining coupling elements are spaced apart by a distance A and are interconnected by bights 8.

Figure 1:
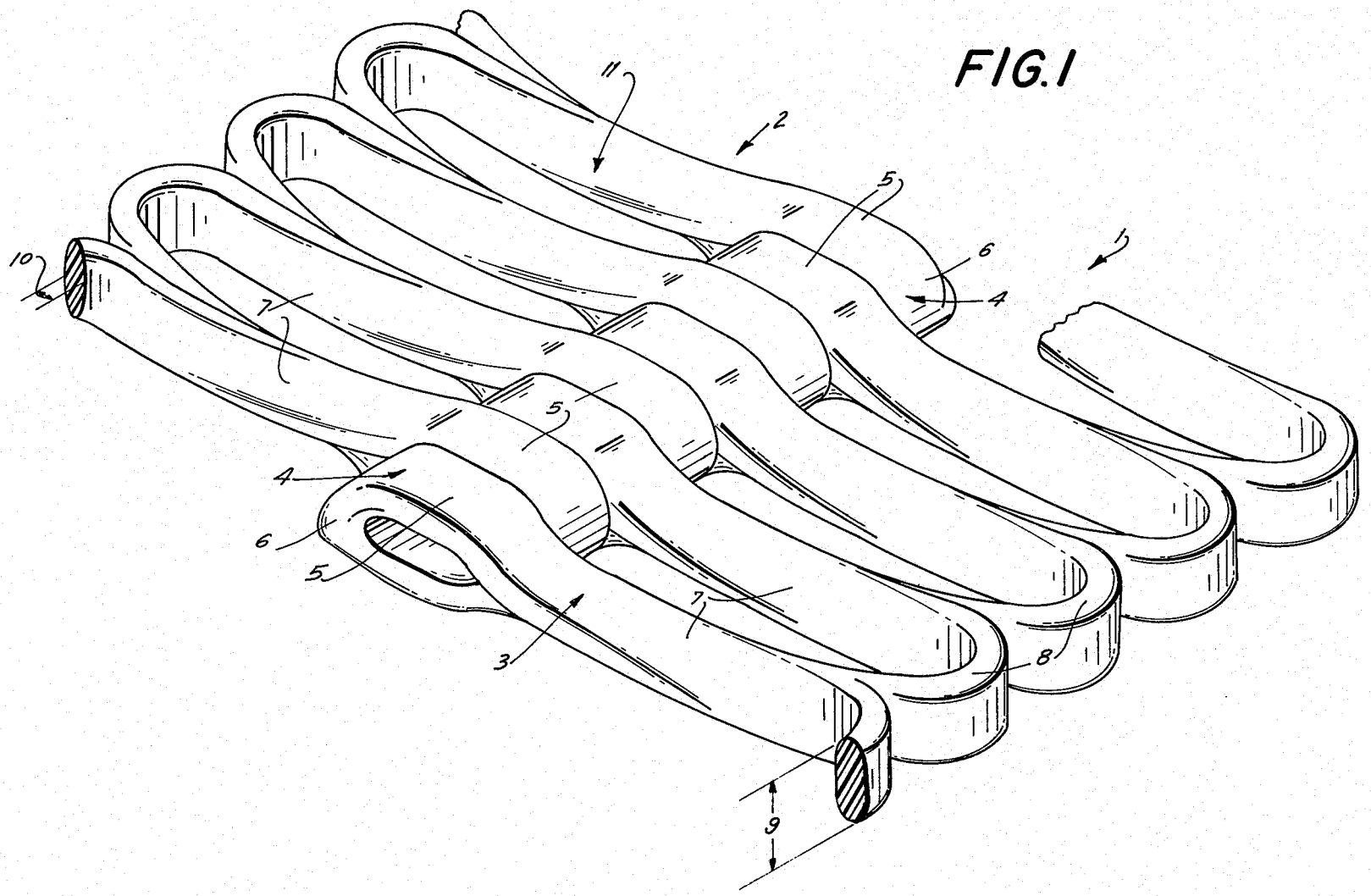
FIG. 1 is a perspective view of a section of interdigitated or coupled rows of coupling elements according to the invention, shown without the longitudinal threads which together with the coupling elements form slide-fastener strips as described in the aforementioned copending applications.
Figure 4:
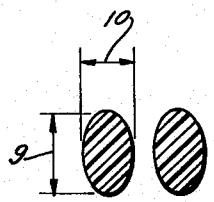
FIG. 4 is a cross-sectional view taken along the line IV—IV of FIG. 2.

As a comparison of FIGS. 1 through 12 will demonstrate, the shanks 7 directly abut and either can lie generally parallel to the slide fastener plane or can be inclined more or less orthogonally or at acute angles thereto. Preferably the shanks lie next to one another as shown in FIG. 1 so that they lie more or less in a common plane although vertically superimposed relationships of the shanks of each coupling element are also possible. FIGS. 9 through 12 show an arrangement in which the shanks are more or less inclined to the slide fastener plane and, for the most part, lie one above the other.

Figures 7, 8:
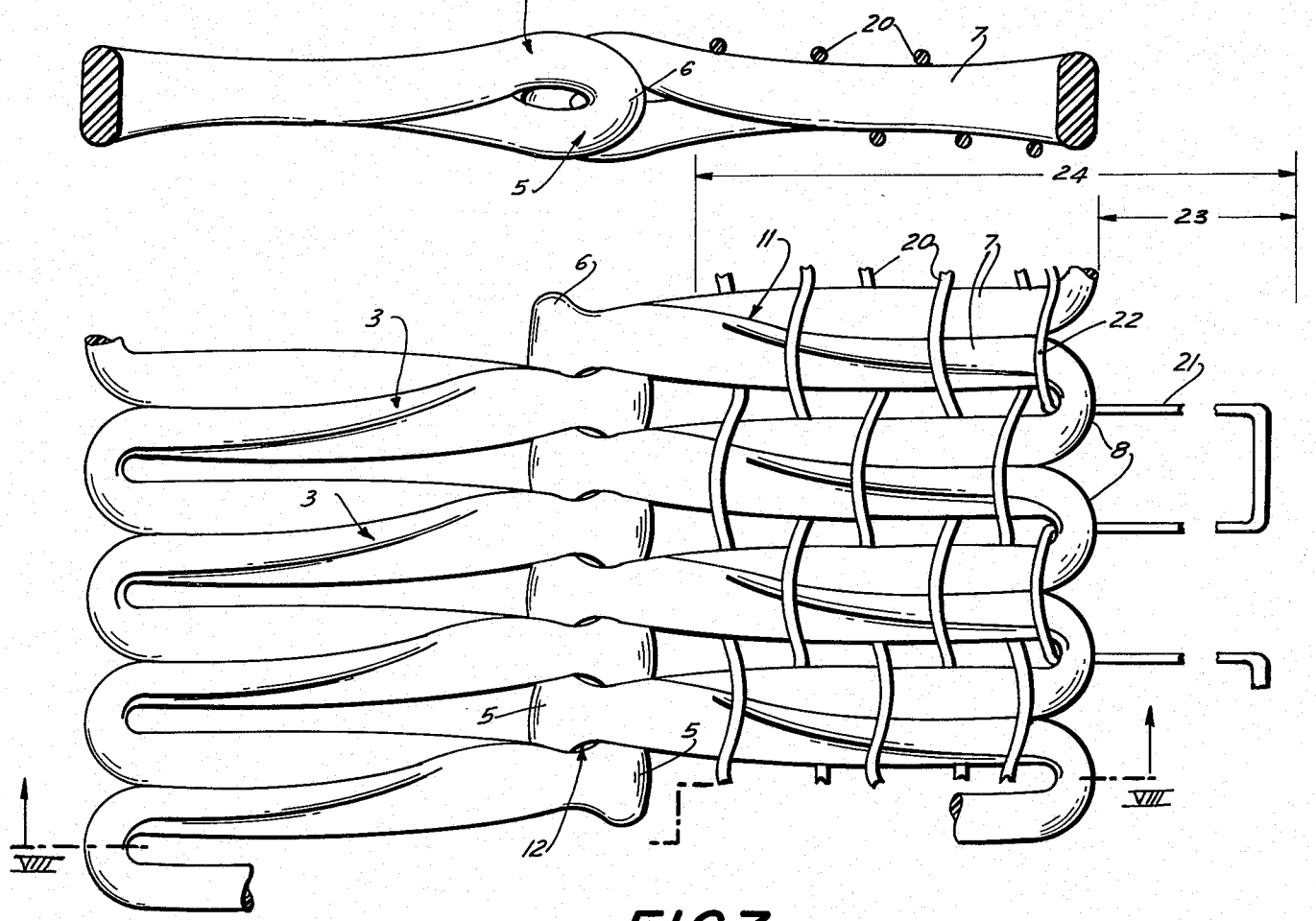
FIG. 7 is a view similar to FIG. 1 illustrating another embodiment of the invention.
FIG. 8 is a cross-sectional view taken along the line VIII—VIII of FIG. 7.
Figure 10:
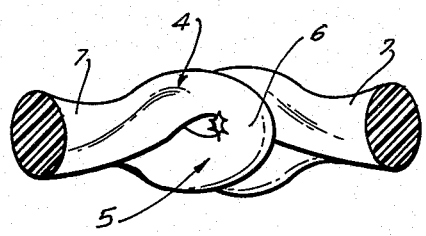
FIG. 10 is a cross section taken along the line X—X of FIG. 9.
Figure 9:
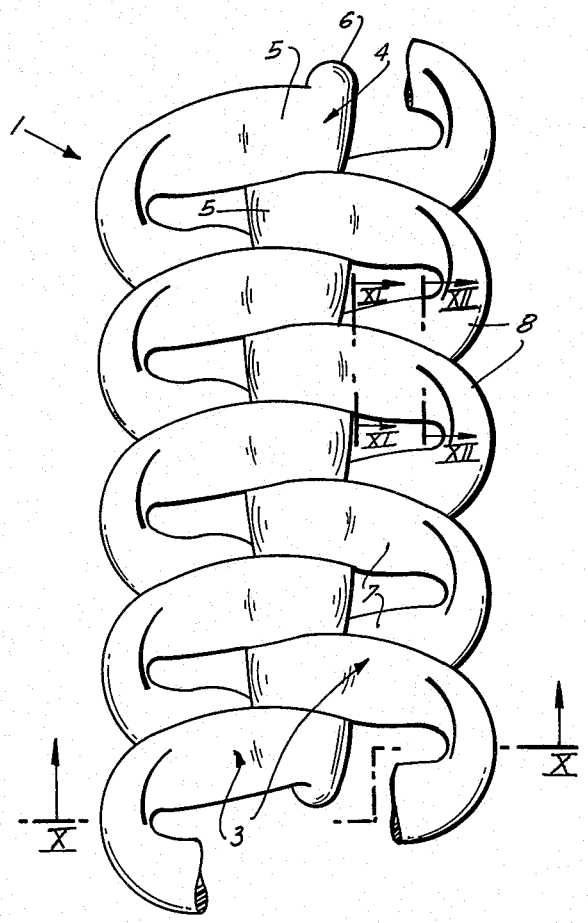
FIG. 9 is a view similar to FIG. 7 showing still another embodiment of the invention having relatively short shanks interconnecting the coupling heads and the bights.
Figure 11:
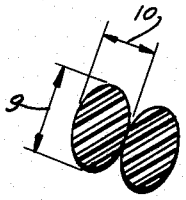
FIG. 11 is a cross-sectional view taken along the line XI—XI of FIG. 9.
Figure 12:
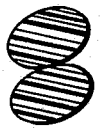
FIG. 12 is a view taken in section along the line XII—XII of FIG. 9.

In general the shanks 7 are formed into coupling strips with the aid of textile longitudinal threads which have been represented at 20 in FIGS. 7 and 8. When the bights 8 form the edge of the strip, no additional weft threads are required and each pair of shanks of a given coupling element lie as a double weft in the structure formed by the warp threads. However, it is also possible to provide an additional tape 23 so that the overall coupling element and tape arrangement is represented at 24. A weft thread 21 of the tape portion 23 is looped around the bights 8 as shown at 22.

As is best seen from the cross-sectional views 3 through 6, 8 and 10 through 12, the synthetic-resin monofilaments of the coupling elements 2 is substantially ellipsoidal in section and have a relatively long axis 9 and a relatively short axis 10, the axes 9 and 10 corresponding to the major and minor axes of the ellipse.

In the region of the coupling heads 9 and the eyes 5, the long axis 9 of the cross section is parallel to the slide fastener plane and, therefore, to the axis of the respective coils. In the region of the bights 8, however, the long axis 9 lies perpendicular to the slide fastener plane. In the case of the bights 8, therefore, the short axes 10 lie parallel to the slide fastener plane at any cross section through the bight.

In the region between the coupling eyes 5 and the bights 8, the shank 7 is formed with transition twists 11 such that the total twist rotates the ellipse through approximately 90°. In the embodiment of FIG. 1 the twist is substantially uniform from the coupling eyes to the bight over the lengths of the shanks 7.

Figure 2:
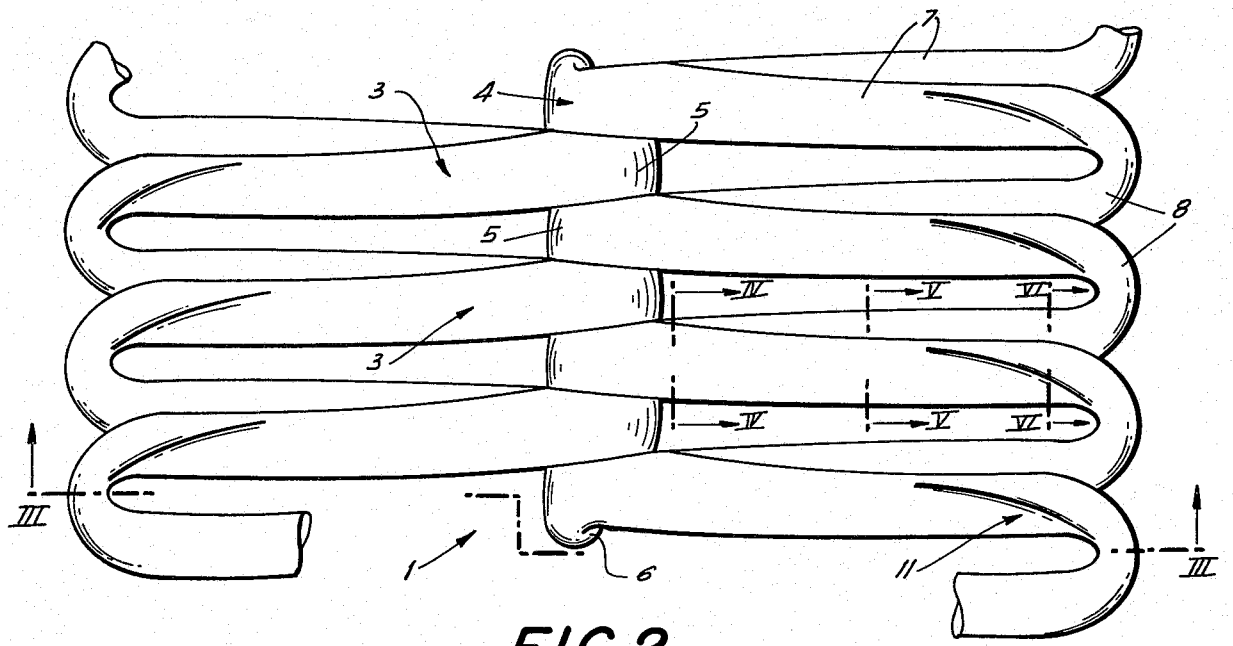
FIG. 2 is a plan view of a pair of coupling rows according to an embodiment of the invention corresponding generally to that of FIG. 1.

In FIG. 2, however, it can be seen that the major portion of the twist is displaced towards the bights 8.

Figure 5:
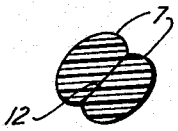
FIG. 5 is a cross-sectional view taken generally along the line V—V of FIG. 2.
Figure 6:
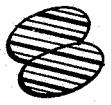
FIG. 6 is a cross-sectional view taken along the line VI—VI of FIG. 2.
Figure 3:
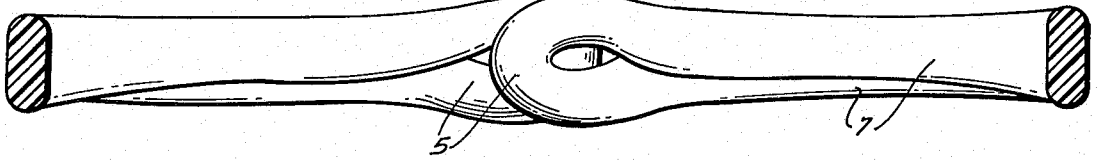
FIG. 3 is a cross-sectional view taken along the line III—III of FIG. 2.

To ensure effective abutting relationship between the paired shanks, they may be pressed together as best seen, for example, in FIGS. 5 and 6 to lie in surface contact along mutually confronting and contacting flats which can be formed in the coupling elements when they are pressed together along the shanks.

The ratio of the axial lengths of the long axis 9 to the short axis 10 in regions other than those in which the additional flat means 12 are provided, are between 1:1.5 and 1:2.

As noted previously, the shanks 7 can be as long as required to incorporate the shanks as the weft in a weave having longitudinal threads forming the warp and crossing over between each pair of shanks.

It is possible to provide the shanks 7 as relatively short (FIGS. 9 through 12), the latter arrangement being desirable when the coupling elements are to be stitched to a tape or to be incorporated in a knit or weave as a support tape by conventional means.

Figure 13:
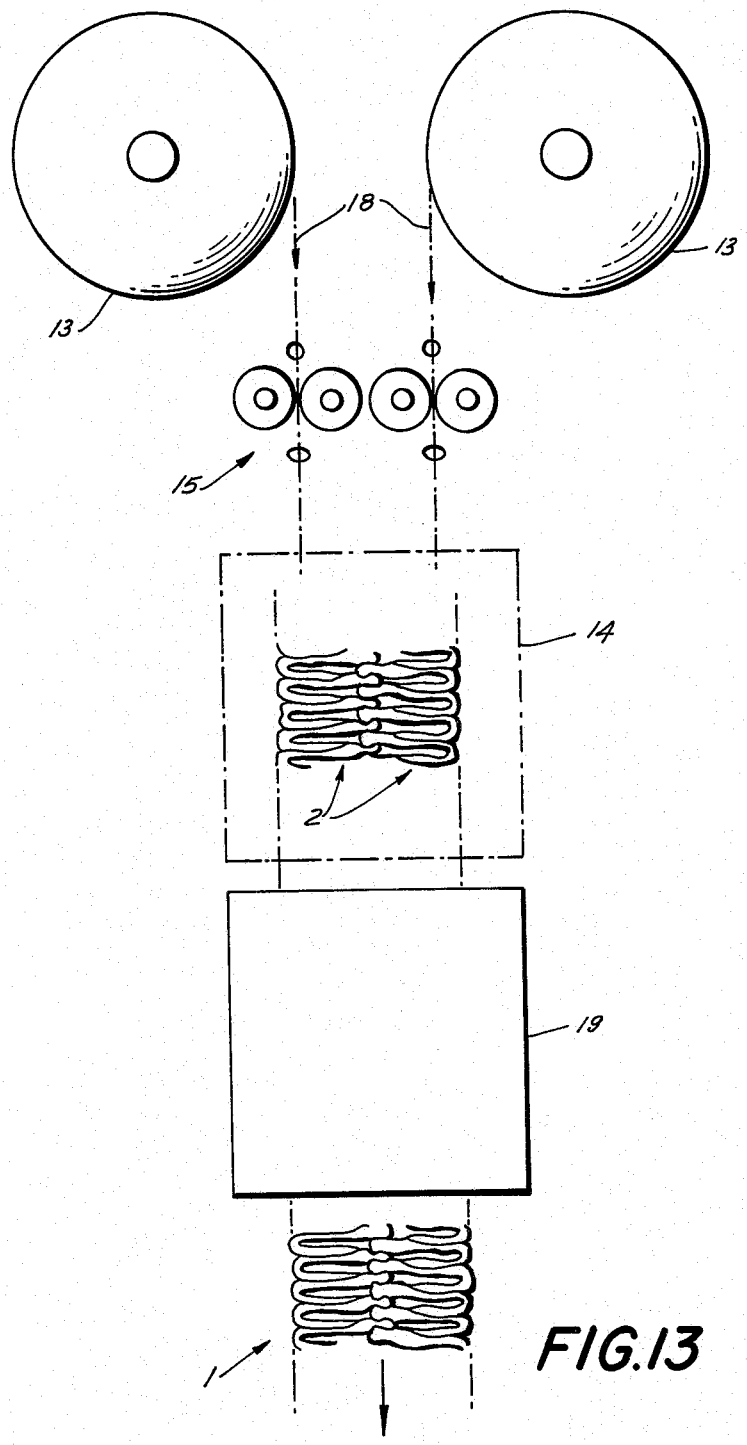
FIG. 13 is a schematic diagram illustrating the flattening of the cylindrical synthetic-resin monofilaments forming the coupling elements of FIGS. 1 through 12 according to the invention.

FIG. 13 shows an apparatus for flattening the continuous strands of the synthetic-resin monofilament before they are advanced into the loom in which they are woven into the tape-like units. The starting material for the fabrication of the coupling rows according to the invention are circular-cross section stretched synthetic-resin monofilaments which are drawn from supply spools 13 and are stretched with a ratio as described. The monofilaments 18 are woven into the respective slide-fastener halves as described in connection with FIGS. 19 through 24 below. The loom is diagrammatically illustrated at 14 while 19 represents a thermofixing arrangement in which the internal stresses within the monofilaments are relaxed.

Ahead of the loom 14 is a roller assembly 15 in which the monofilament is flattened to impart a long axis 16 and a short axis 17 to the cross section of the monofilament. This will be apparent from FIG. 16 of the drawing.

The long axis 16 is greater than the major diameter 9 of the ellipsoid while the short dimension 17 is less than the minor diameter 10 of the ellipsoid, the flattening being carried out continuously and without the formation of plate-like embossments such as have been described in the aforementioned copending applications. Beyond the rollers, the coupling element relaxes into the ellipsoid shape shown in dot-dash line in FIG. 16*a*.

The coupling strand is laid into a coil pattern 2 in the loom 14 with the coupling beads being bent around a central mandrel and the tightness of this bend produces buckling which forms lateral projections at the head represented at 6*a* in FIG. 14.

The protuberances may be produced exclusively by buckling the coupling heads during the formation thereof or by additional pressing. The buckling tends to retain the flattened configuration shown in solid lines in FIG. 16*a*. The coupling element shanks are twisted through 90° and further buckling bends are formed at the bights 18 so that here too the flattened configuration can be retained. Of course, if the strand is thermofixed when it has the flattened configuration shown in solid lines in FIG. 16, this configuration will be retained over the entire length of the coupling element. The thermofixing can effect shrinkage of the coupling element as well to impart the broken line or dot-dash configuration of FIG. 16*a*. Advantageously, the flattening at the rollers 15 as carried out in a cold state, i.e., at a temperature below the vitreous or glass transformation temperature while the thermofixing is carried out by heating or ultrasonically.

FIGS. 19 and 20 illustrate the basic elements of the apparatus for fabricating interdigitating strip slide fastener structures using the coupling elements of FIGS. 1 through 6 and represented, in FIGS. 19 and 20, at 101.

The apparatus comprises a warp-feed beam (not shown) from which the warp threads 103 are passed between a pair of rollers 103*a* in the direction of arrow 103*b*, the warp threads traversing respective heddles 102*a* of a harness 102 capable of forming a warp shed 104. As will be apparent from FIG. 20, the warp threads are divided into two groups and have a space between them.

From each side of the loom respective weft-inlaying needles 105 carry the respective synthetic-resin monofilaments 106 into and through the respective sheds. To this end, the needles 105 are carried by arms 105*a* and 105*b* driven by links 105*c* which are articulated to the arms 105*a*, 105*b* at pivots 105*d*. Each link is swingable on an eccentric pin 105*e* driven by a wheel 105*f* so that the needles are swung alternately to the right and to the left through respective sheds. The needles are synchronized with the heddle control (not shown) which can be of the usual tape-weaving type, and with the batten or reed 119 which is swingable, as can be seen in FIG. 19, to beat up the weft as it is led into the shed. Guides 116 engage the filaments to form the bights remote from the heads and prevent the weft inlaying from pulling the warp 103 inwardly.

As is also apparent from FIG. 19, the monofilament 106 is drawn from a spool 117 through a traveling eye 117*a* and passes over a guide roller 117*b* and between a pair of eyes 117*c* and 117*d* between a pair of embossing rollers 118 which flatten the strand 106. The ellipsoidal monofilament is then passed through a spring loaded eye 117*e* and a guide 117*f* to the eyelets 105*g* of the respective weft-inlay needle. The loom housing 130 is formed with a channel 120 through which the interlocked coupling elements are guided on to a takeoff unit 21 comprising a plurality of rollers 121*a*. 121*b* and 121*c* which frictionally engage the strip and reversely bend it to facilitate variation of the strip. A thermofixing devide in the form of a heater as represented at 122 above the guide 120 can be provided and, as will become apparent hereinafter, the bending mandrel 108 can also be extended into a heated portion which effects thermofixing of the heads.

The flexible mandrel 108 is disposed centrally between the weft sheds 104 for the respective slide fastener halves and, at the end 110 of the mandrel turned away from the downstream end 109 of the weft shed, is mounted in a raisable and lowerable mandrel holder 111 slidably.

As can be seen from FIG. 20, the weft-inlaying needles 105 lie in horizontal planes disposed one above the other so that their filament-entraining ends can cross over in the shed 104.

The mandrel holder 111 is received in a centrally interrupted vertical guide 112 and can be shifted by a plunger arrangement 113 between its upper and lower positions in which it is retained by magnets 114 (FIG. 21).

Of course, this holding arrangement 114 can be eliminated and the device can be constituted, as shown in FIG. 22, with rounded corners 115 of the mandrel holder 111' so that it is cammed (FIGS. 22 and 22*a*) into its upper and lower positions.

The device illustrated in FIGS. 19 through 21 operates as follows:

Two supply spools 117 feed respective synthetic-resin monofilaments 106 through respective embossing roller pairs 118 to the respective weft needles. As can be seen from FIG. 20, the weft needles 105 lay the monofilament 106 into the warp shed across the lower set of warp threads and pass the mandrel 111. The mandrel 111 thereupon drops and the needles 105 withdraw the filament again across the lower threads of the shed. The harness is actuated to reverse the shed and the weft is beaten up by the reed 119. Each shed, therefore, forms a pocket for a pair of mutually contacting shanks of the coupling elements. The process is repeated with the new shed and as many times as necessary to produce the desired length of slide fastener.

The length of the mandrel 108 is so selected that the coupling heads withdraw therefrom only after a considerable number of coupling heads are interdigitated by the needles. The mandrel can remain in place within the coupling heads until thermofixing has relaxed the stresses of the monofilament. Advantageously, the warp filaments are shrinkable and are subjected to a thermal shrinking operation to reduce their length by 10 to 15% to ensure a particularly tight grip of the shanks in the warp pockets.

The system has been described for the fabrication of a substantially coiled coupling element in which the coupling heads are generally wound around the mandrel. However, it was possible to provide the coupling elements 107 as U-shaped meander structure in which case the inlaying needles 105 are displayed directing the respective weft inlays so that one monofilament is brought over the other and vice versa in successive operations.

The system illustrated in FIGS. 23 and 24 differs from that of FIGS. 19 through 21 only in that the weft needles carry, in addition to the weft needle 105 for the monofilament, designed to coil the latter over only part of the width of the web (see FIG. 7), needles 124 which carry the additional weft threads 123 across the region 23 of the tape to hook into the bights of the filament before they reach the mandrel 108. A weft thread lifter 125 is here provided to insure proper engagement of each bend of the monofilament with the textile thread weft. The remaining structure of course is the same as that of FIGS. 19 through 21 and a similar mode of operation prevails.

We claim:

1. In a slide fastener having a pair of rows of interdigitatable coupling elements formed from respective continuous synthetic-resin monofilaments, each of said coupling elements comprising a loop-forming coupling eye provided with a head, a pair of shanks extending away from said eye and respective bights connecting the shanks to the shanks of adjacent coupling elements, the improvement wherein:

(a) the monofilament forming each of said rows is of generally ellipsoidal cross-section with major and minor axes;

(b) the major axis of the cross-section of the monofilament in the region of each of said eyes lies generally parallel to the slide fastener plane;

(c) the minor axis of the cross-section in the region of the bights lies generally parallel to the slide fastener plane; and (d) at least one transition twist is provided along each shank between the respective head and bight.

2. The improvement defined in claim 1 wherein said shanks are flattened.

3. The improvement defined in claim 2 wherein said heads are formed as buckled thermofixed portions of the monofilament.

4. The improvement defined in claim 1 wherein said shanks are formed with thermofixed flattenings and the shanks of each coupling element are paired with their flattenings in mutually abutting relation.

5. The improvement defined in claim 1 wherein the ratio of the minor axis to the major axis is substantially 1:1.5 to 1:2.

6. The improvement defined in claim 5 wherein said rows of coupling elements form parts of respective tape-like units with respective groups of longitudinal threads defining pockets receiving the shanks of each coupling element in mutually abutting relation, said shanks constituting a double weft laid into the pockets of the respective units.

7. The improvement defined in claim 6 wherein said longitudinal threads are warp threads crossing between the paired shanks.

8. The improvement defined in claim 6, further comprising a respective tape formed integrally with each of said units and provided with a weft thread looped around the coupling elements thereof.

* * * * *